US006075450A

United States Patent [19]

Clark

[11] Patent Number: 6,075,450

[45] Date of Patent: Jun. 13, 2000

[54] AUDIBLE WARNING DEVICE WITH RESTRAINABLE, SHOCK-ACTIVATED COCKED MECHANISM

[76] Inventor: Lloyd Douglas Clark, 15 Conrad St., San Francisco, Calif. 94131

[21] Appl. No.: 09/149,231

[22] Filed: Sep. 8, 1998

[51] Int. Cl.[7] ..... G08B 3/00

[52] U.S. Cl. ..... 340/691.1; 340/689; 340/546; 340/908; 42/65

[58] Field of Search ..... 340/691.1, 689, 340/546, 908, 545.5; 116/203, 63 C; 42/65

[56] References Cited

U.S. PATENT DOCUMENTS

| | | | |
|---|---|---|---|
| 3,660,817 | 5/1972 | Abrams | 340/689 |
| 4,679,033 | 7/1987 | Hwang | 340/689 |
| 4,896,139 | 1/1990 | Eldridge | 340/546 |
| 5,166,665 | 11/1992 | McCarthy | 340/691.1 |
| 5,548,914 | 8/1996 | Anderson | 42/65 |
| 5,565,642 | 10/1996 | Heitz | 42/65 |
| 5,661,474 | 8/1997 | Douglas | 340/908 |

*Primary Examiner*—Jeffery A. Hofsass
*Assistant Examiner*—John Tweel, Jr.

[57] ABSTRACT

A shock-activated, sonic alarm is silent when in a stored or cocked condition. In the cocked or armed condition, a spring-loaded plunger (160) is restrained by a ring (200) from activating an alarm (100). When the alarm is dealt a sharp blow, the plunger (160) is dislodged and freed from the ring so that its spring (170) forces it against a cap (120) or a switch (410), resulting in a loud alarm. The alarm can be placed in any location where it is desirable to sound an alarm in response to a physical trauma, such as in a traffic barrier or dangerous goods shipment.

20 Claims, 3 Drawing Sheets

AUDIBLE WARNING DEVICE WITH RESTRAINABLE, SHOCK-ACTIVATED COCKED MECHANISM

BACKGROUND—FIELD OF INVENTION

This invention relates generally to audible warning devices, and in particular to warning devices which are activated by a physical blow.

PRIOR-ART—BARRIERS

Road construction is a dangerous occupation. Because of their proximity to traffic, road workers are occasionally struck by vehicles and maimed or killed. At present, they are minimally protected by warning signs which advise drivers in advance of the presence of the workers. Nearer the work site, brightly colored cones or poles are placed on or near the roadway to direct vehicles around the workers and their equipment. Frequently, there are no rigid barriers which can stop errant vehicles which might injure the workers.

Unfortunately, workers are frequently unaware of approaching danger. They cannot always watch traffic while they work. A careless motorist may drive through flimsy, temporary barriers almost noiselessly and strike a worker who is unable to get out of the way of the approaching vehicle.

Most temporary barriers are made of a flexible, plastic material. When these are struck by a moving vehicle they are deflected, or they deform as the vehicle passes over them. In both cases, the interaction of the barrier with the moving vehicle is virtually silent. In many cases, the worker is in the vicinity of loud machinery and is unable to hear the vehicle as it approaches, even though the barrier is struck by the vehicle.

PRIOR-ART—CIVIL DISOBEDIENCE OR HOSTAGE SITUATIONS

Situations involving civil disobedience and hostages are dangerous to all involved. Tear gas and concussion grenades are sometimes used to confuse the perpetrators long enough for law enforcement personnel to gain the upper hand. Both of these methods are potentially more destructive to personnel and property than the situation merits.

PRIOR-ART—TRANSPORT OF FRAGILE OR DANGEROUS MATERIALS

Fragile and dangerous materials are often subject to damage or leaking when their container is shocked. For example, a plastic bottle containing a flammable substance may leak in the cargo hold of an airplane, placing the passengers, crew, and other cargo at risk from fire or fumes. At present, there is no audible alarm which indicates that a delicate package has been dropped or bumped hard enough to cause breakage of its contents.

OBJECTS AND ADVANTAGES

Accordingly, one object and advantage of the present invention is to provide an improved method of protecting workers who are required to work behind a physical barrier in the proximity of moving vehicles. Another object is to provide an audible alarm which is associated with the visible barrier. Another object is to provide an audible alarm which will alert the operator of a vehicle when the vehicle has struck a barrier. Still another object is to provide an audible alarm which will alert other drivers in the vicinity that a barrier has been struck. A further object is to provide an alarm which additionally gives a visual indication of its activation. A further object is to provide an alarm which creates a diversion but is not harmful or destructive to personnel or property. Another object is to provide an audible shock indicator for use in delicate or dangerous goods shipments.

Additional objects and advantages will become apparent from a consideration of the drawings and ensuing description thereof.

SUMMARY

In accordance with the present invention, a method and apparatus are provided which use a plurality of visible and audible warning devices to audibly alert all personnel in the vicinity of a barrier that the barrier has been breached. An audible alarm is provided which is activated by a physical blow. In order that the alarm not activate unintentionally, the acceleration associated with the physical blow must exceed a certain threshold. In order that the alarm not continue indefinitely, a mechanism is provided to stop the alarm after it has been activated. Visible indication of a breached barrier is optionally provided by emission of a colored dye cloud into the air surrounding the alarm device.

DRAWING FIGURE REFERENCE NUMERALS

Figure 1:
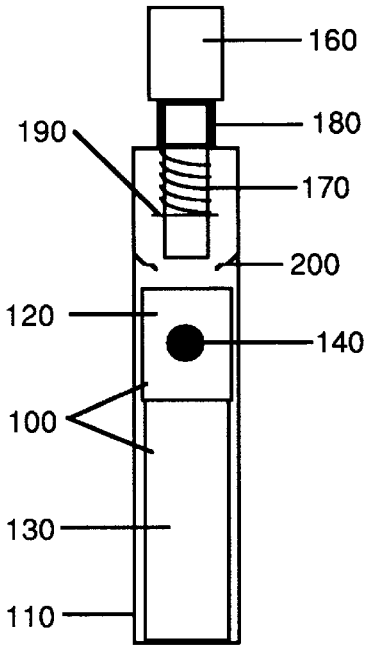
FIG. 1 is a cross-sectional view of a gas-powered embodiment of the instant alarm, showing the plunger in a restrained condition.

100 Gas-powered whistle
110 Housing
120 Cap
130 Cylinder
140 Whistle orifice
160 Plunger
170 Spring
180 Collar
200 Ring
210 Hole
220 Annular portion
230 Shoulder portion
240 Annular section
300 Shocking force
310 Colored cloud
400 Battery
410 Switch
420 Buzzer
430 Wire
440 Wire

450 Pivot
700 Cone
710 Hole
720 Arm
721 Arm

Figure 2:
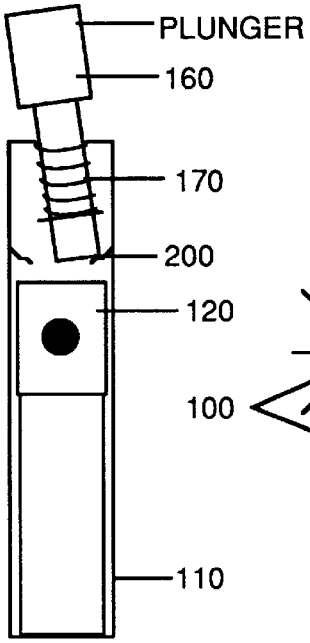
FIG. 2 shows the alarm of FIG. 1 in a cocked condition.
Figure 3:
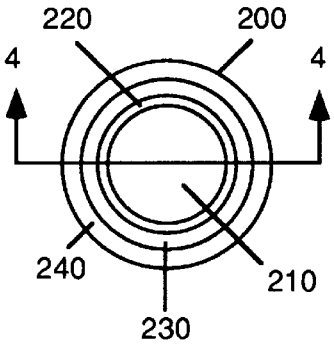
FIG. 3 is a detail of the cocking ring shown in FIG. 2.

FIRST PREFERRED EMBODIMENT—COMPRESSED GAS POWERED ALARM—FIGS. 1, 2, and 3

The embodiment of FIGS. 1 to 3 is a gas-powered alarm which can be used in road traffic situations to alert highway workers to any dangerous breach in the perimeter of their work area.

FIG. 1—STORAGE CONDITION—ALARM SILENT

A cross-sectional view of a preferred embodiment of the present alarm is shown in FIG. 1 in its silent, or inactivated state. In this embodiment, the sonic generator is a commercially-available, compressed-gas-powered, personal alarm whistle 100.

People with a concern for their own safety have long carried personal alarms. These include sonic generators of various kinds: whistles which are blown by the breath of the user, gas-powered whistles which are activated by pressurized gas in an associated container, and battery-powered electric buzzers. Gas whistles and electric powered buzzers are typically much louder than whistles blown by the user. Such a gas-powered whistle is sold by Personal Safety Corporation, of Cedar Rapids, Iowa, U.S.A., under the mark "Secure Sonic Alarm". This whistle is normally carried in the user's pocket or purse. It is approximately 12.5 cm (5 inches) long, and 2.3 cm (⅞ inch) in diameter. The whistle is contained in the device's cap. It is activated by pressing on the cap, which is attached to a pressurized container. The volume level of the whistle's sound is sufficient for it to be heard at a distance of 400 meters (¼ mile).

Whistle 100 comprises a cap 120, and an attached pressurized container 130. When cap 120, the activating member of the alarm, is depressed, gas passes from container 130, through an orifice 140, and escapes into the atmosphere. As the gas escapes past orifice 140, it emits a very loud, shrill shriek.

Whistle 100 is held within a housing 110. Housing 110 and alarm 100 together comprise a shock-activated alarm.

A plunger 160 passes through the top of housing 110. A compression spring 170 urges plunger 160 downward in the direction of cap 120. In the storage condition of FIG. 1, plunger 160 is withdrawn and prevented from touching cap 120 by collar 180. Collar 180 is a "C"-shaped, hollow cylinder which snaps in place around the smaller diameter portion of plunger 160. The bottom end of spring 170 is restrained by an annular clip 190 which is fixed to the smaller diameter portion of plunger 160. The top end of spring 170 is restrained by the inner, top surface of housing 110. An inner annular ring 200 (FIGS. 3 and 4) is secured to the inside wall of housing 110 for a purpose to be described; it has no function in the storage condition.

Although housing 110 and plunger 160 are shown as round, they can alternatively be hexagonal, square, or another shape.

FIG. 2—COCKED CONDITION—ALARM SILENT

To arm the alarm and make it ready for use, collar 180 (FIG. 1) is removed. Plunger 160 is now free to travel downward toward cap 120, at the urging of spring 170. Inner ring 200 contains a central hole which is larger in diameter than the smaller-diameter portion of plunger 160. Inner ring 200 is shaped so that the bottom end of plunger 160 can rest against it. Plunger 160 is tilted and allowed to move down under the influence of spring 170 so that it is held in place against ring 200 under pressure exerted by spring 170. Plunger 160 is now cocked and remains in the cocked position because of frictional forces at the interface between the lower end of plunger 160 and the upper surface of ring 200. Thus to "cock" the alarm, the user simply removes collar 180 (FIG. 1) and tilts plunger 160 while lowering it until its end rests on ring 200. The alarm is now armed and ready for use. The user must be careful not to jar it while it is in this condition, since any jar will activate it prematurely.

FIGS. 3 AND 4—COCKING MECHANISM—RING DETAIL

Figure 4:
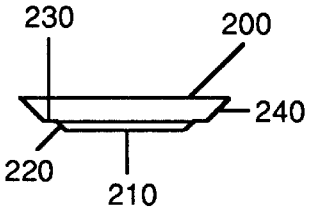
FIG. 4 is a cross-sectional view of the cocking ring of FIG. 3.

A holding member, or ring 200 is shown in more detail in FIGS. 3 and 4. It preferably has a hole 210, surrounded by a first short radius flaring up and out annular portion 220, a flat, annular shoulder portion 230, and a second larger radius annular flaring up and out section 240. In the cocked position, the bottom tip of plunger 160 (FIG. 1) temporarily rests against shoulder 230 without sliding off. In the alarming condition, described below, the lower end of plunger 160 (FIG. 1) passes through hole 210 in ring 200. FIG. 4 shows a cross-section of ring 200, taken along 4—4 in FIG. 3. Ring 200 preferably has an outer diameter equal to the inner diameter of housing 110, preferably 2.5 cm (1 inch) in the present example. The diameter of hole 210 in the center of ring 200 is typically 1.59 cm (⅝ inch). The height of ring 200 is preferably 0.48 cm (3/16 inch).

FIG. 5—ALARMING CONDITION

Figure 9:
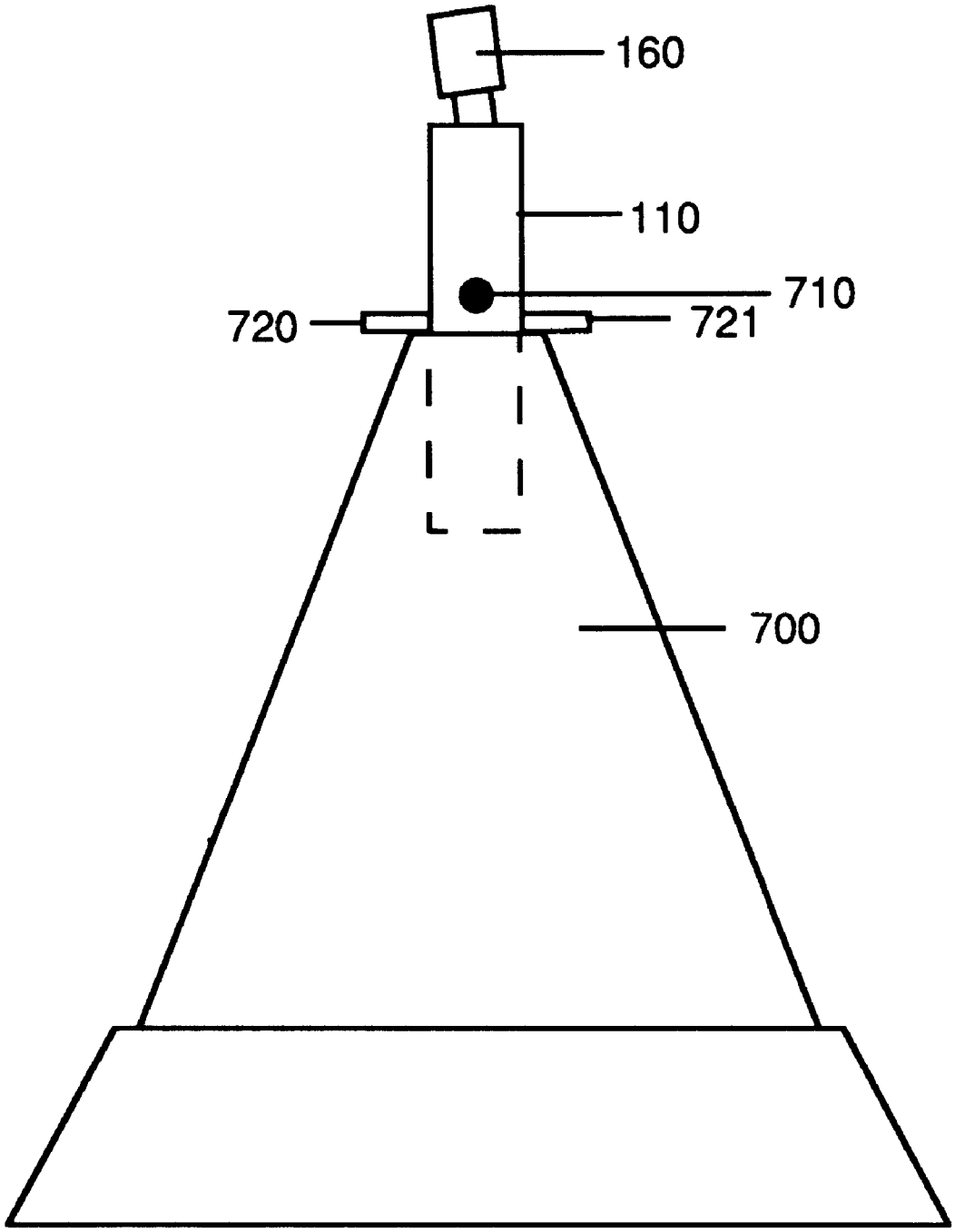
FIG. 9 shows the alarm in use, positioned in a traffic cone.

After the alarm is cocked, the user carefully places it where it will be used. In the case of traffic barriers, the alarm is placed in the top of a familiar traffic cone (FIG. 9). In the case of a police action, the alarm is held by the user until it is forcibly thrown against a surface in the area where a disturbance is required, as described below.

When a shocking force 300 is applied to the alarm, plunger 160 is dislodged from its rest position against ring 200. Spring 170 then forces plunger 160 downward against cap 120, depressing it. When cap 120 is depressed, whistle 100 is activated and emits a loud shriek. The alarming sound will continue until whistle 100 is out of gas or until plunger 160 is manually withdrawn from cap 120.

The compressed gas (not shown) in whistle 100 may contain a colorant. When the colorant is present, a visible gas cloud 310 is emitted when whistle 100 is activated. The combination of sound and cloud 310 permits rapid location of the alarm.

SECOND PREFERRED EMBODIMENT—ELECTRICALLY-POWERED ALARM—FIGS. 6, 7, AND 8

Figure 5:
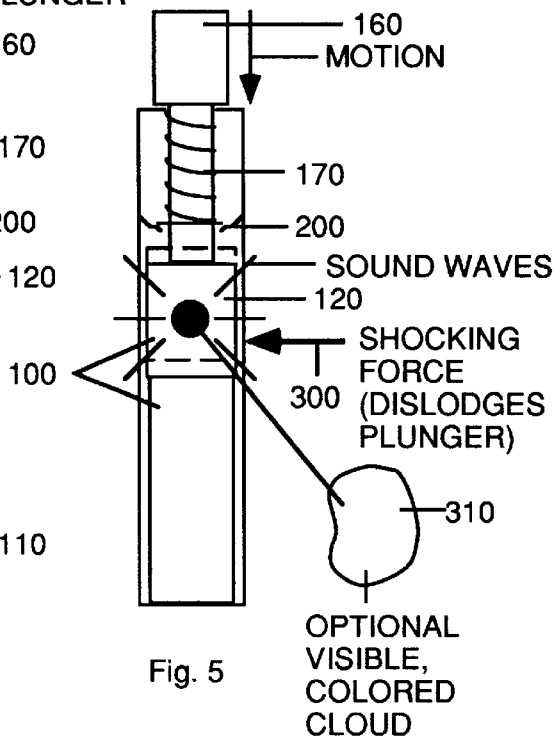
FIG. 5 is a cross-sectional view of the alarm of FIG. 1 in the alarming condition.
Figure 6:
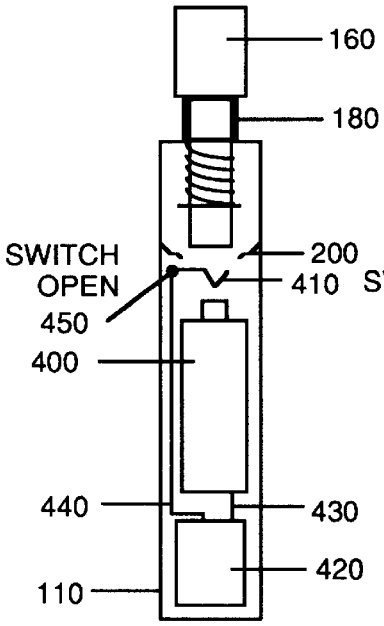
FIG. 6 is a cross-sectional view of an electrically powered embodiment of the instant alarm, showing the plunger in a restrained condition.
Figure 7:
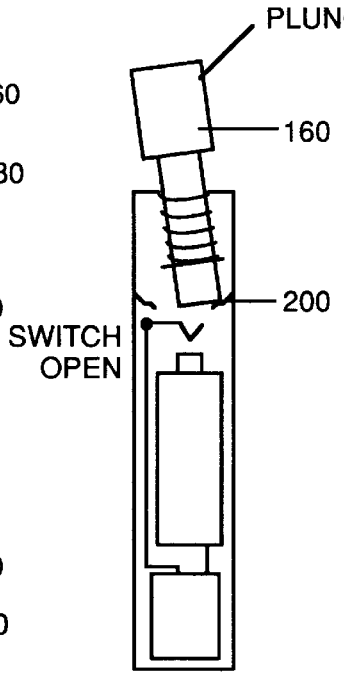
FIG. 7 shows the alarm of FIG. 6 in a cocked condition.
Figure 8:
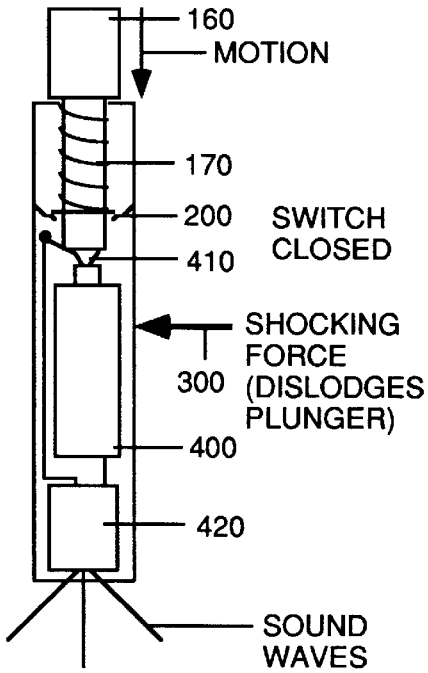
FIG. 8 is a cross-sectional view of the alarm of FIG. 6 in the alarming condition.

The alarm in FIGS. 6, 7, and 8 is another embodiment which resembles and is equivalent in function to the alarm in FIGS. 1, 2, and 5. In this embodiment however, the internal noise-making components are different.

FIG. 6—STORAGE CONDITION—ALARM SILENT

Gas-powered sonic generator whistle 100 (FIGS. 1, 2, and 5) is replaced by a battery 400, a switch activating member 410, and a sonic generator buzzer 420. An electric powered alarm can be assembled from a battery, a switch, and a buzzer unit. Such a buzzer unit is sold by Matsushita, Inc. of Japan, under the mark "Panasonic". For example, their model EFB-RM38C13 emits a 3.5 kHz sound with an intensity of 96 decibels (dB) when energized with 10 volts. The diameter of the buzzer is 29 mm (1.14 inch). A suitable battery is the model LC-R121R3PU, also sold under the "Panasonic" mark. The size of this battery is 9.7×4.75×5 cm (3.8×1.9×2.0 inch). A suitable switch is model TP11SH9CBE, manufactured and sold by C&K Components, Inc., of Watertown, Mass., U.S.A. This switch is a single-pole, single-throw, momentary, normally-open type. Its size is 0.81×0.51×0.86 cm (0.32×0.2×0.34 inch).

The inside diameter of housing 110 is large enough to accommodate the larger of buzzer 420 or battery 400. Switch 410 is typically smaller than either buzzer 420 or battery 400. For example, the diameter of the Panasonic brand buzzer described above is 29 mm (1.14 inch). Wire 430 connects one pole of battery 400 to a first terminal (not shown) on buzzer 420. Wire 440 connects switch 410 to a second terminal (not shown) on buzzer 420. Switch 410 is a normally-open, single-pole, single-throw switch. Pivot 450 merely supports switch 410 in housing 110.

FIG. 7—COCKED CONDITION—ALARM SILENT

Operation of the electrically-powered alarm of FIGS. 6, 7, and 8 is similar to that of the gas-powered alarm in FIGS. 1, 2, and 5. When the alarm is prepared for use, plunger-restraining collar 180 (FIG. 1) is removed. Plunger 160 is then manually positioned at an angle, resting its lower end on ring 200.

FIG. 8—ALARMING CONDITION

When a shocking force 300 is applied to the alarm, plunger 160 is dislodged from its rest position against ring 200. Spring 170 then forces plunger 160 downward against switch 410, forcing its pole against the top terminal of battery 400 . This closes the circuit comprising battery 400, switch 410, and buzzer 420. Buzzer 420 is activated and emits a loud shriek. The alarming sound will continue until the charge of battery 400 is depleted, or until plunger 160 is manually withdrawn from cap switch 410.

APPLICATION OF ALARM SYSTEM—FIG. 9

One embodiment of the alarm is shown mounted in a familiar, soft plastic traffic cone 700. Cone 700 is typically 0.6 meter (2 ft) tall. It is truncated at its top. This permits insertion of the body of the alarm. Arms 720 and 721 have been added to outer case 110 in order to support the alarm in cone 700. The alarm is most vulnerable to a mechanical shock at this height. Since plunger 160 is cocked, the alarm will be activated when struck by a moving vehicle.

A hole 710 in body 110 of the alarm permits escape of the sound generated within orifice 140 (FIG. 1). In the case of the electrically-activated alarm of FIG. 6, hole 710 is located at the bottom of body 110, near the sound outlet (not shown) of buzzer 420 (FIG. 6).

In use, cone 700 containing the alarm is strategically placed within or at a protective barrier, for example a line of other cones, sawhorses, police tape, and the like, so that it will be struck if the barrier is breached. Thus when a vehicle enters the barrier it will strike cone 700 and activate the alarm. When the alarm is activated, it sounds and alerts workers so that they can escape to safety.

SUMMARY, RAMIFICATIONS, AND SCOPE

It is thus seen that the present system provides a warning when a barrier is breached. In particular, one form of the barrier is an inexpensive, movable barrier comprising plastic cones or poles. The alarm is cocked, then inserted into the top portion of a barrier cone or pole. When a moving vehicle strikes the barrier, the alarm is hit and sounds, thus giving personnel in the area warning that a barrier has been breached—potentially preventing injury and saving lives. The barrier concept also can be used in factories, mines, farms, and any place where notice must be given that the barrier has been breached.

Another problem solved by the present system is the defusing of civil disobedience or hostage situations. The alarm is cocked, then thrown into the midst of a tense situation where it activates on jarring contact with a surface. Consider the example of a person with a gun who is threatening others inside a store. Law enforcement officers throw the alarm into the store. The person with the gun is distracted, and the officers can take control of the situation.

The gas-powered embodiment of the alarm can also contain a colorant which forms a distinctive cloud when the alarm activates. In the case of road barriers, this can readily indicate the source of the alarm sound. In the case of the store situation, the colored cloud can further confuse and distract the person with the gun.

The gas-powered embodiment of the alarm can also contain a chemical which has a noxious odor or is an irritant. In the case of the store situation, the odor can further confuse and distract the person with the gun.

Another problem is solved by placing the alarm inside dangerous or fragile goods shipments. When the materials and alarm are subjected to a blow or dropped, the alarm sounds to alert personnel that the materials in the shipment may have been compromised. It can also be placed in any other location where it will be advantageous to create a loud sound when the alarm housing is subjected to a physical trauma.

The alarm can have shapes other than cylindrical. The actuator can be other than a cap or switch, for example a button or a lever, or the like. The ring can be a non-annular ledge, or other type of gear or catch.

While the present system employs elements which are well known to those skilled in the arts of mechanical and electrical engineering, traffic safety, and law enforcement, it combines elements from these fields in a novel way which produces a new result not heretofore discovered.

Accordingly the scope of this invention should be determined, not by the embodiments illustrated, but by the appended claims and their legal equivalents.

I claim:

1. A system for producing an audible alarm, comprising:

a. a non-detonating sonic generator comprising a body having a movable activating member, said sonic generator being arranged to emit a loud sound while said activating member is moved from an initial position, b. a plunger for moving said activating member, c. a spring which urges said plunger toward said activating member, d. a holding member sensitive to physical trauma for holding said plunger in a cocked position away from said activating member, said holding member being arranged, in response to said trauma thereto, to allow said plunger to move from said cocked position and thereby reach and move said activating member, and e. a housing for holding said sonic generator, said plunger, said spring, and said holding member in proximity with one another, whereby said physical trauma to said housing will cause said housing member to jar said holding member, which will in turn release said plunger which, under the urging of said spring, will move said activating member of said sonic generator, so that said sonic generator is activated in response to said physical trauma.

2. The system of claim 1 wherein said activating member is a cap, said body comprises a compressed gas cylinder, and said sonic generator is powered by compressed gas.

3. The system of claim 2 wherein said compressed gas contains a colorant.

4. The system of claim 1 wherein said activating member is a switch, said body comprises an interconnected battery and buzzer connected to said switch, and said sonic generator is electrically powered.

5. The system of claim 1, further including a collar for restraining said plunger from being moved from a restrained position.

6. The system of claim 1, further including a hole in said housing for escape of sound generated by said sonic generator.

7. The system of claim 1 wherein said holding member has an annular shape.

8. A method for producing an audible alarm, comprising:

providing a housing which is trauma-sensitive, holding a sonic generator in a fixed position within said housing, said non-detonating sonic generator comprising a body having an activating member and being arranged to emit a loud sound while said activating member is depressed, cocking a spring-loaded plunger in a cocked position against a holding member away from said activating member, and allowing said plunger to reach and depress said activating member when said plunger is released from said cocked position, said housing being arranged to dislodge said plunger from said holding member in response to said trauma, placing said housing in a location where it will be advantageous for said sonic generator to emit said loud sound when said housing is subject to a physical trauma, whereby said physical trauma to said housing will cause said housing member to jar said holding member, which will in turn release said plunger which, under the urging of said spring, will move said activating member of said sonic generator, so that said sonic generator is activated in response to said physical trauma.

9. The method of claim 8 wherein said activating member is a cap, said body comprises a compressed gas cylinder, and said sonic generator is powered by compressed gas.

10. The method of claim 9 wherein said compressed gas contains a colorant.

11. The method of claim 8 wherein said activating member is a switch, said body comprises an interconnected battery and buzzer connected to said switch, and said sonic generator is electrically powered.

12. The method of claim 8, further including a collar for restraining said plunger from being moved from a restrained position.

13. A method for producing an audible alarm, comprising:

providing sonic non-detonating generator means having an activating member, said sonic generator means being arranged to produce said audible alarm while said activating member is actuated, providing plunger means responsive to trauma for operating said activating member, providing collar means for preventing said plunger from operating said activating member, providing spring means for urging said plunger toward said activating member, providing housing means for holding said sonic generator, plunger, and activating member, and placing said housing means with said sonic generator, said plunger, and said activating member in a location where it will be advantageous for said sonic generator to emit said loud sound, whereby said physical trauma to said housing will cause said housing member to jar said holding member, which will in turn release said plunger which, under the urging of said spring, will move said activating member of said sonic generator, so that said sonic generator is activated in response to said physical trauma.

14. The method of claim 13 wherein said sonic generator means is powered by a source selected from the group consisting of gas and electricity.

15. The method of claim 14 wherein said source is a gas which contains a colorant.

16. The method of claim 13 wherein said housing includes a hole for escape of sound generated by said sonic generator.

17. The method of claim 13 wherein the cross-section of said plunger is round.

18. The method of claim 13 wherein the cross-section of said plunger is other than round.

19. The method of claim 13 wherein the cross-section of said housing is round.

20. The method of claim 13 wherein the cross-section of said housing is other than round.

* * * * *